US006769561B2

(12) United States Patent
Futral et al.

(10) Patent No.: US 6,769,561 B2
(45) Date of Patent: Aug. 3, 2004

(54) PLASTIC BOTTLE WITH CHAMPAGNE BASE

(75) Inventors: Daniel M. Futral, Marietta, GA (US); Lesley S. Corker, Atlanta, GA (US)

(73) Assignee: Ball Corporation, Broomfield, CO (US)

( * ) Notice: Subject to any disclaimer, the term of this patent is extended or adjusted under 35 U.S.C. 154(b) by 50 days.

(21) Appl. No.: 10/266,484

(22) Filed: Oct. 8, 2002

(65) Prior Publication Data

US 2003/0116525 A1 Jun. 26, 2003

Related U.S. Application Data

(60) Provisional application No. 60/342,679, filed on Dec. 21, 2001.

(51) Int. Cl.[7] ..... B65D 1/02; B65D 1/42

(52) U.S. Cl. ..... 215/373; 215/371; 220/606; 220/609

(58) Field of Search ..... 215/371, 373; 220/606, 608, 609

(56) References Cited

U.S. PATENT DOCUMENTS

| | | | | |
|---|---|---|---|---|
| 3,511,401 | A | | 5/1970 | Lachner |
| 3,718,229 | A | | 2/1973 | Wyeth et al. |
| 3,722,726 | A | | 3/1973 | Carmichael et al. |
| 3,811,588 | A | | 5/1974 | Vermeerbergen et al. |
| 3,881,621 | A | | 5/1975 | Adomaitis |
| 4,108,324 | A | | 8/1978 | Krishnakumar et al. |
| 4,231,483 | A | | 11/1980 | Dechene et al. |
| 4,247,012 | A | | 1/1981 | Alberghini |
| 4,342,398 | A | | 8/1982 | Chang |
| 4,403,706 | A | | 9/1983 | Mahajan |
| 4,465,199 | A | | 8/1984 | Aoki |
| 4,525,401 | A | | 6/1985 | Pocock et al. |
| 4,725,464 | A | | 2/1988 | Collette |
| 4,755,404 | A | | 7/1988 | Collette |
| 4,780,257 | A | | 10/1988 | Beck |
| 4,889,752 | A | | 12/1989 | Beck |
| 4,892,205 | A | | 1/1990 | Powers et al. |
| 4,894,268 | A | | 1/1990 | Greenwood et al. |
| 4,927,679 | A | | 5/1990 | Beck |
| 4,969,563 | A | | 11/1990 | Strassheimer |
| 4,989,738 | A | | 2/1991 | Thayer et al. |
| 5,038,947 | A | | 8/1991 | Strassheimer |
| 5,198,248 | A | | 3/1993 | Krishnakumar et al. |
| 5,217,737 | A | | 6/1993 | Gygax et al. |
| 5,599,496 | A | | 2/1997 | Krishnakumar et al. |
| 5,763,030 | A | * | 6/1998 | Matsui ..... 428/35.7 |
| 5,853,829 | A | | 12/1998 | Krishnakumar et al. |
| 6,176,382 | B1 | * | 1/2001 | Bazlur Rashid ..... 215/373 |
| 6,409,035 | B1 | * | 6/2002 | Darr et al. ..... 215/373 |
| 6,595,380 | B2 | * | 7/2003 | Silvers ..... 215/373 |
| 6,635,217 | B1 | * | 10/2003 | Britton ..... 264/532 |

OTHER PUBLICATIONS

U.S. Trademark Registration No. 859,424, Oct. 29, 1968.
U.S. Trademark Registration No. 862,948, Dec. 31, 1968.
U.S. Trademark Registration No. 1,304,431, Nov. 6, 1984.
U.S. Trademark Registration No. 1,362,284, Sep. 24, 1985.
U.S. Trademark Registration No. 1,398,744, Jun. 24, 1986.
U.S. Trademark Registration No. 1,443,707, Jun. 16, 1987.
U.S. Trademark Registration No. 1,504,209, Sep. 13, 1988.
U.S. Trademark Registration No. 1,564,941, Nov. 7, 1989.
U.S. Trademark Registration No. 1,764,776, Apr. 13, 1993.

* cited by examiner

*Primary Examiner*—Sue A. Weaver
(74) *Attorney, Agent, or Firm*—Brinks Hofer Gilson & Lione

(57) ABSTRACT

A molded plastic bottle has a base having an outside surface rotationally symmetric about a longitudinal axis of the bottle including a convex heel and a central concavity separated by a standing ring supporting the bottle on an underlying surface. The convex heel has an upper margin integrally formed with the sidewall of the bottle and a lower margin defining an outer portion of the standing ring. The central concavity includes a first surface having a lower most portion defining an inner portion of the standing ring. The standing ring inner portion and outer portion intersect in an abrupt edge with the inner portion of the standing ring generally being inclined with respect to the plane at an angle of between about 30° and 50°.

19 Claims, 5 Drawing Sheets

PLASTIC BOTTLE WITH CHAMPAGNE BASE

CROSS-REFERENCE TO RELATED APPLICATIONS

This application is based on U.S. provisional application No. 60/342,679 filed Dec. 21, 2001.

BACKGROUND OF THE INVENTION

The present invention is directed to molded plastic bottles having a champagne style bottom structure closing the container lower end. The phrase champagne style is in reference to a base having an outside surface rotationally symmetric about a longitudinal axis of the bottle including a convex heel having an upper margin integrally formed with the lower end portion of the bottle sidewall, and a central concavity separated from the convex heel by a continuous standing ring that supports the bottle on any underlying surface.

There has be an increasing demand for a plastic bottle that will satisfy the market demands for packaging beer. Many technical problems associated with packaging beer in plastic containers have been previously addressed. The need for low oxygen transporation has yielded special blended polymers, and the additional of barrier coatings and layers of a variety of materials. Beer is generally carbonated to a level comparable to carbonated soft drinks, so the pressure that any container for beer can be expected to experience is significant. This internal pressure provided by the carbonation proves to be of little consequence for bottles designed for soft drinks that employ a bottom containing a plurality of individual feet. However, such a footed structure has generally been found to be commercially unacceptable as a package for beer to the purchasing public, which has come to expect a champagne style base on beer bottles based on its past experience with glass bottles. The standard champagne base has long been employed with glass bottles to distribute forces exerted on the base due to any internal pressure to the sidewall of the bottle. The standard champagne base shape has evolved in various ways in attempts to better withstand these forces. While the use of a champagne base has proven to be desirable in glass, the application of such designs to plastic containers has proven to be difficult as the strengths and weakness of glass and plastic simply are not the same.

The plastic container industry has found the standard champagne base to be an unacceptable configuration for blow molding of plastic bottles because, for example, the standard champagne dome or push-up has been found to be susceptible to inversion when constructed from plastic. To prevent such inversion, it is common practice to increase the thickness of a majority of the base relative to the thickness of the remainder of the bottle. To achieve this thickness variation, some parisons have been designed to place material concentrations in specific predetermined areas of the base, such as a reinforced hoop in the area of the chime, to increase the bottle resistance to stress. Some champagne base configurations required the use of a parison having a stepped or otherwise specially shaped lower end portion to increase the thickness of the base in a selected area to a thickness that is substantially thicker than in other comparable bases. These configurations represent very difficult manufacturing problems as the parisons require very long reheating schedules to achieve the uniform heating required to permit the biaxial stretching of the parison during formation of the bottle. The very long reheating schedule translates either into a slow manufacturing process or into extraordinary capital outlay for very long reheating paths with lots of sensors and controls for coordinating the parison reheating. Even when the proper reheating schedules are followed, the correct placement of the thicker areas at the desired locations in the bottle does not always occur, which results in bottles that do not remain perpendicular or even fail when placed under pressure due to the internal carbonation.

What is needed is a design for a plastic bottle having a champagne style base that is capable of being blow molded from a parison having a substantially uniform wall thickness that allows for a more straight forward reheating cycle prior to blow molding the container, yet results is a container having a very stable base under conditions that are typically experienced by bottles of beer.

SUMMARY OF THE INVENTION

A molded plastic bottle of the present invention has a sidewall and a bottom structure closing the container at a lower end portion of the sidewall that is within the champagne base family. That is, the bottom structure has an outside surface rotationally symmetric about a longitudinal axis of the bottle that includes a convex heel and a central concavity connected together by a seating ring. The convex heel has an upper margin of diameter D integrally formed with the lower end portion of the sidewall of the container. A lower margin of the convex heel defines an outer portion of the standing ring that supports the bottle on any underlying surface. Preferably, the standing ring outer portion has a vertical inside radius of curvature of at least about 0.04 D. The central concavity includes a first surface having a lower most section defining an inner portion of the standing ring. The first surface has a vertical curvature radius of at least about 0.8 D, with the center of curvature being located either inside or outside the first surface. Thus the first surface can be slightly concave or slightly convex, or even conical. The standing ring inner portion and outer portion intersect in an abrupt edge defining the lowermost portion of the bottle, which forms a continuous circle lying in a plane normal to the vertical or longitudinal axis of the container. The inner portion of the standing ring is inclined with respect to the plane containing the abrupt edge of the standing ring at an angle of between 20° and 60°.

The angle of the inner surface defining the standing ring, coupled with the small initial outward radius of the outer surface defining the standing ring, permits sufficient polymer to be blown into the standing ring area to achieve the desired performance characteristics for the bottle without requiring that the parison have a thicken region related to this portion of the bottle as was common in the prior art. Additionally, the abrupt edge defining the lowermost portion of the bottle at the standing ring provides an exceedingly strong resistance to roll-out that appears to minimize the opportunity for bottom failure by way of either inversion or blowout. The inner surface of the abrupt edge is the first surface of the central concavity, which in the preferred embodiments is inclined with respect to the plane of the standing ring at an angle of between about 30° and 50°, and most preferably at an angle of about 40°. The outer surface of the abrupt edge is formed by the lower margin of the convex heel and preferably has a vertical inside radius of curvature that is between about 0.045 D and 0.095 D.

In a preferred embodiment of the molded plastic bottle of the present invention, the upper margin of the convex heel that merges with the sidewall has a vertical inside radius of curvature of between about 0.7 D and 0.8 D. The upper margin of the convex heel forming the junction with the sidewall is preferably situated at between about 0.35 D and 0.40 D above said plane containing the standing ring. The combined curves of the convex heel portion cause the standing ring circle to have a diameter of between about 0.7 D and 0.8 D which provides the necessary stability for the bottle, while retaining a comfortable holding shape of the bottle.

While the central concavity of a bottle of the present invention might be constructed with only a single internal surface, in the preferred embodiments the central concavity includes a second surface having an outer margin spaced uniformly inward from the standing ring and integrally formed with the first surface. The outer margin of the second surface is generally positioned between about 0.1 D to 0.3 D from the longitudinal axis of the bottle. Preferably, the second surface is downwardly convex and includes a lowermost point coincident with the longitudinal axis of the bottle that is spaced upward from the standing ring plane. Generally, the space between the lowermost point of the second surface and the standing ring plane is between about 0.05 D and 0.3 D. In a preferred embodiment, the second surface has a radius of curvature of between about 0.25 D and 1.3 D.

Bottles of the present invention are observed to maintain the structural integrity of the heel and exhibit minimal roll out thus promoting stability of each bottle both during initial filling and during any extended shelf life. Further, these characteristics are reproducible in the bottle of the present invention at commercially acceptable speeds from a parison of substantially uniform wall thickness. These and other features and advantages of the present invention will be apparent from the following discussion of preferred embodiments of the present invention, which makes reference to the attached drawings exemplifying the best mode of carrying out the present invention as now perceived by the inventors.

DESCRIPTION OF PREFERRED EMBODIMENTS

Figure 1:
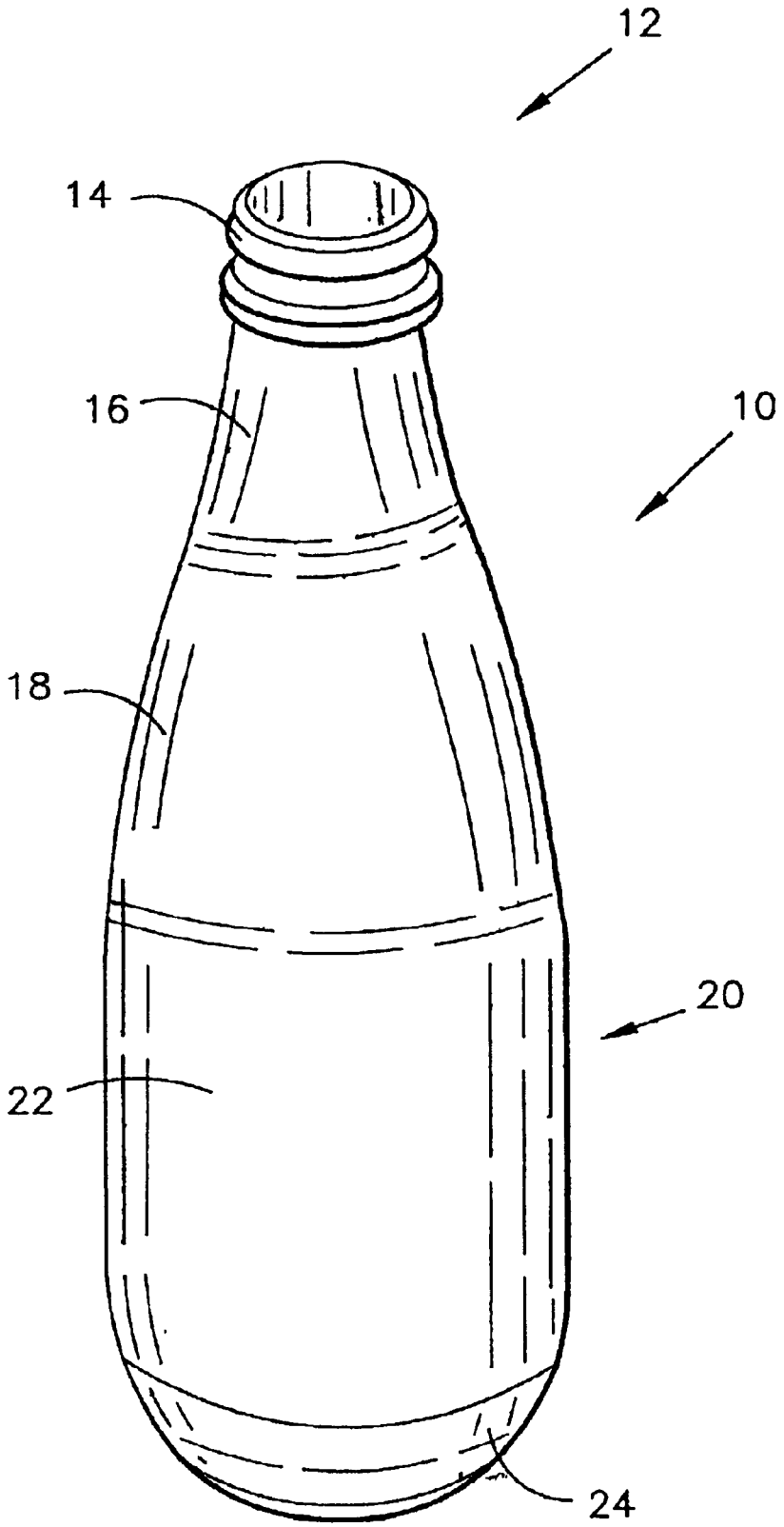
FIG. 1 is a perspective view of a bottle of the present invention designed to hold about 500 ml or less.

A container according to the present invention is depicted in FIG. 1 in the form of a bottle 10. The bottle 10 of the present invention has a top end 12 with a crown finish 14 for receiving a crown closure (not shown) to seal the bottle 10 after filling with a desired product such as beer. An integral tapered neck 16 extends downward and outward from the top end 12 widening to form an integral shoulder 18. The shoulder 18 then leads into an integral body portion 20 of the bottle 10 that includes a cylindrical wall 22. An integral base 24 of the bottle 10 closes the bottom end of the body portion 20. Preferably, the bottle 10 is formed by blow molding the bottle 10 from a standard preform or parison having a substantially uniform wall thickness using conventional blow molding techniques generally known as a two-step or re-heat and blow process. In that process, the heated parison is biaxially stretched and expanded by internal air pressure within a blow mold of a defined geometry that determines the outside shape of the bottle 10. While certain aspects of the bottle such as those relating to overall height, diameter, and curvature of the shoulder and neck portion are subject to variation based principally on esthetic design, the bottom end of the integral base 24 is primarily functionally determined within the criteria set forth in the preceding summary of the present invention. The criteria lead to a range of possible shapes, some of which are illustrated in FIGS. 2 through 9.

Figure 2:
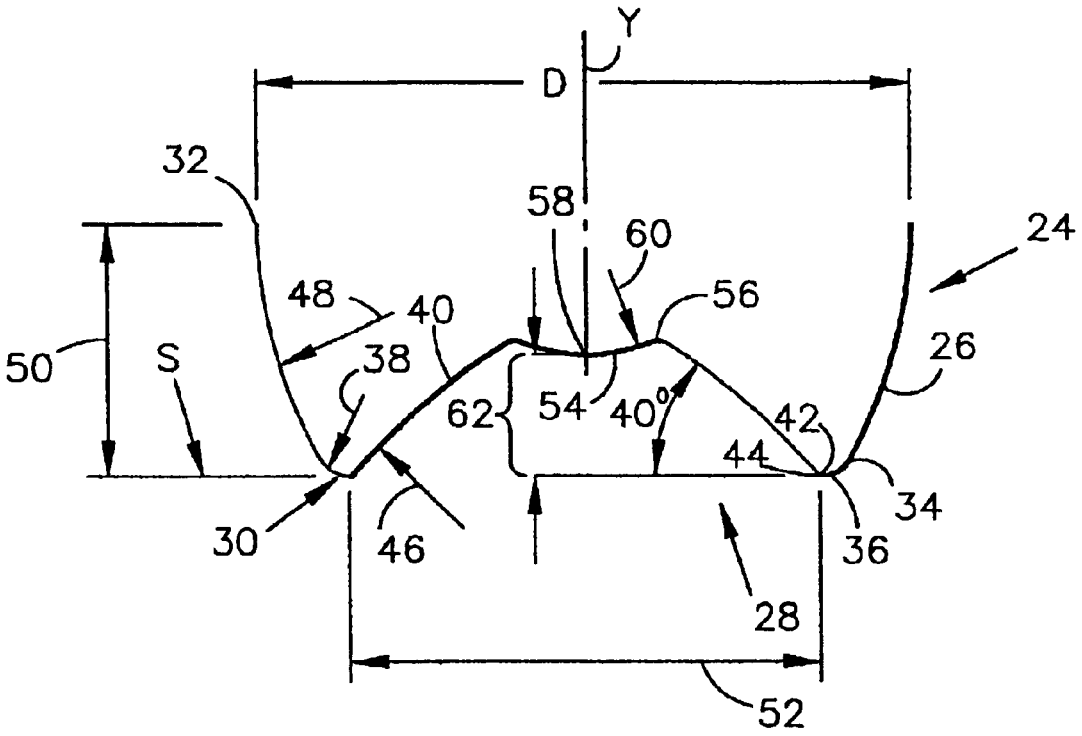
FIG. 2 is a diagrammatic sectional view of a first preferred embodiment for a base suitable for use in the bottle of FIG. 1.

FIG. 2 shows a first preferred embodiment for a base 24 suitable for use in the bottle 10. The base 24 of the present invention has an outside surface rotationally symmetric about a longitudinal axis Y of the bottle 10 that includes a convex heel 26 and a central concavity 28 connected together by a standing ring 30 that supports the bottle 10 on any underlying surface S. The convex heel 26 has an upper margin 32 of diameter D integrally formed with the lower or bottom end portion of the sidewall 22 of the bottle 10 shown in FIG. 1. A typical diameter for a bottle 10 designed to hold around 500 ml is about 6 cm. A lower margin 34 of the convex heel 26 defines an outer portion 36 of the standing ring 30. The standing ring outer portion 36 of the embodiment shown in FIG. 2 has a small vertical inside radius of curvature 38 of about 0.06 D, or about 3.1 mm. The central concavity or push-up 28 includes a first surface 40 having a lower most section 42 defining an inner portion 44 of the standing ring 30. The first surface 40 has a vertical curvature radius 46 of at least about 0.8 of D and more typically about 7.6 m, with the center of curvature being located below the first surface 40 so that the first surface 40 is slightly concave.

The standing ring inner portion 44 and outer portion 36 intersect in an abrupt edge 42 defining the lowermost portion of the bottle 10. The abrupt edge 42 of the standing ring 30 forms a continuous circle lying in the plane S normal to the vertical or longitudinal axis Y of the bottle 10 so that the bottle 10 is supported by any underlying surface with the axis Y being perpendicular to the supporting surface. The inner portion 44 of the standing ring 30 is inclined with respect to the plane defined by the abrupt edge 42 of the standing ring 30 at an angle of about 40°. In the embodiment shown in FIG. 2, the upper margin 32 of the convex heel 24 that merges with the sidewall 22 has a vertical inside radius of curvature 48 of about 0.73 D or about 4.5 cm.

Additionally, the upper margin 32 of the convex heel 24 is situated at a distance 50 of about 0.38 D or about 2.3 cm above plane S containing the standing ring 30. The combined curves 38 and 48 of the convex heel portion 26 cause the standing ring circle of the embodiment shown in FIG. 2 to have a diameter 52 of about 0.73 D or about 4.5 cm.

The central concavity 28 of the embodiment shown in FIG. 2 includes a second surface 54 having an outer margin 56 spaced uniformly inward from the standing ring 30 and integrally formed with the first surface 40. The outer margin 56 of the second surface 54 is positioned in the embodiment shown in FIG. 2 at about 0.1 D or about 6 mm from the longitudinal axis Y. The second surface 54 is shown to be downwardly convex with a radius of curvature 60 of about 0.28 D or about 1.7 cm. The second surface 54 includes a lowermost point 58 coincident with the longitudinal axis Y of the bottle 10 that is spaced upward from the standing ring plane S. In the embodiment shown in FIG. 2, the space 62 between the lowermost point 58 of the second surface 54 and the standing ring plane S is about 0.18 D or about 1.1 cm. A bottle 10 made with the base 24 shown in FIG. 2 from a parison of 36.6 grams maintains its shape and structural integrity, and exhibits minimal roll out when filled with 470 ml of beer both during initial filling and during its intended shelf life.

Figure 3:
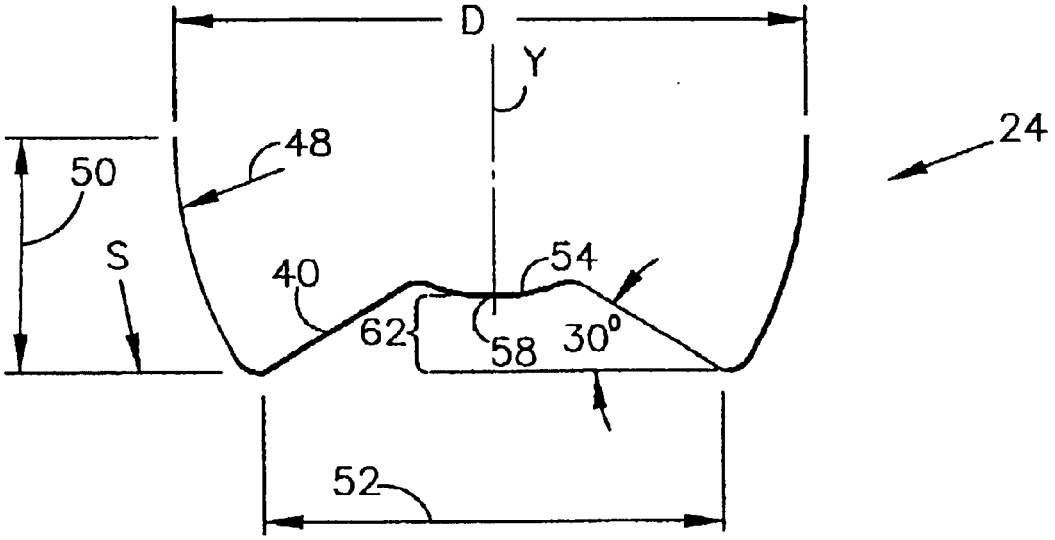
FIG. 3 is a diagrammatic sectional view of a second preferred embodiment for a base suitable for use in the bottle of FIG. 1 in which the first surface of the central concavity is conical and inclined at smaller angle.

FIG. 3 shows a second preferred embodiment for a base 24 suitable for use in the bottle 10 of FIG. 1 in which the first surface 40 of the central concavity is conical, being formed by the rotation of a straight line inclined at an angle of 30° around the axis Y. The straight line forming the conical surface 40 can be thought of as a curve having a radius 46 that is infinitely large. The base in FIG. 3 is otherwise unchanged from the base shown in FIG. 2 except that the second surface 54 is positioned lower than in the embodiment shown in FIG. 2 so that the lowermost point 58 is spaced from the plane S by a distance of about 0.1 D or about 7 mm. Despite this close spacing between the lowermost point 58 and the plane S, the base 24 configured as shown in FIG. 3 shows sufficient stability and structural integrity to contain beer in the amount indicated with reference to FIG. 2 when formed from the uniform wall thickness parison discussed previously.

Figure 4:
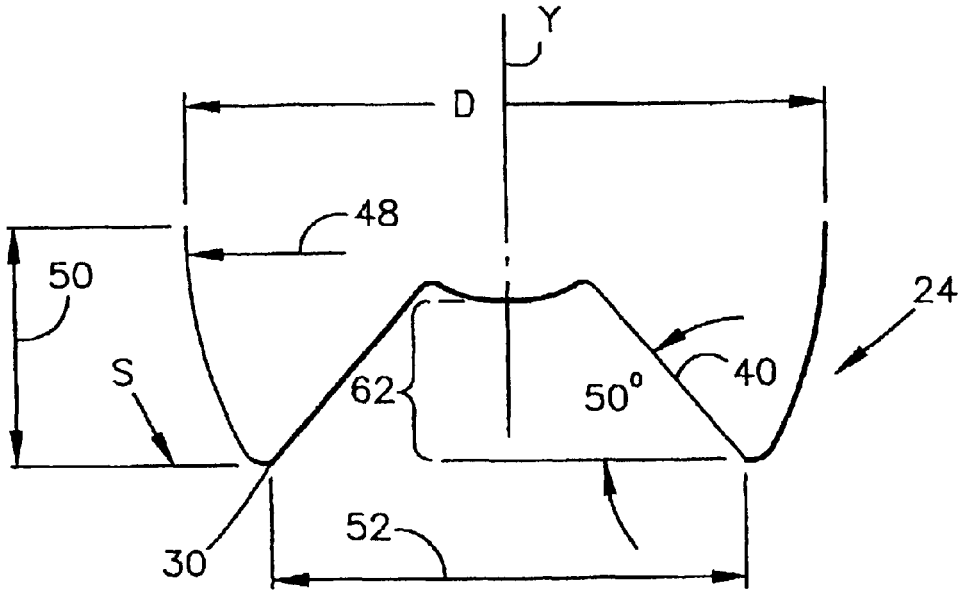
FIG. 4 is a diagrammatic sectional view of a third preferred embodiment for a base suitable for use in the bottle of FIG. 1 in which the first surface of the central concavity is inclined at a larger angle than in FIG. 2 or 3.

FIG. 4 shows a third preferred embodiment for a base 24 suitable for use in the bottle 10 of FIG. 1 in which the first surface 40 of the central concavity 28 is inclined at an angle of 50° and is again formed as a conical surface generated by the rotation of a straight line around the axis Y. The second surface 54 is shown to be spaced by a much larger distance 62 than in the embodiments of FIGS. 2 and 3 of about 0.27 D or about 1.6 cm. The other characteristics of this base remain unchanged form the base shown in FIG. 3. The base design shown in FIG. 4 does perform satisfactorily, however, it probably represents a limit on satisfactory designs of the present invention since the standing ring 30 may not be completely filled with polymer if the distance 62 is increased any further or the angle of inclination of surface 40 increased any further.

Figure 5:
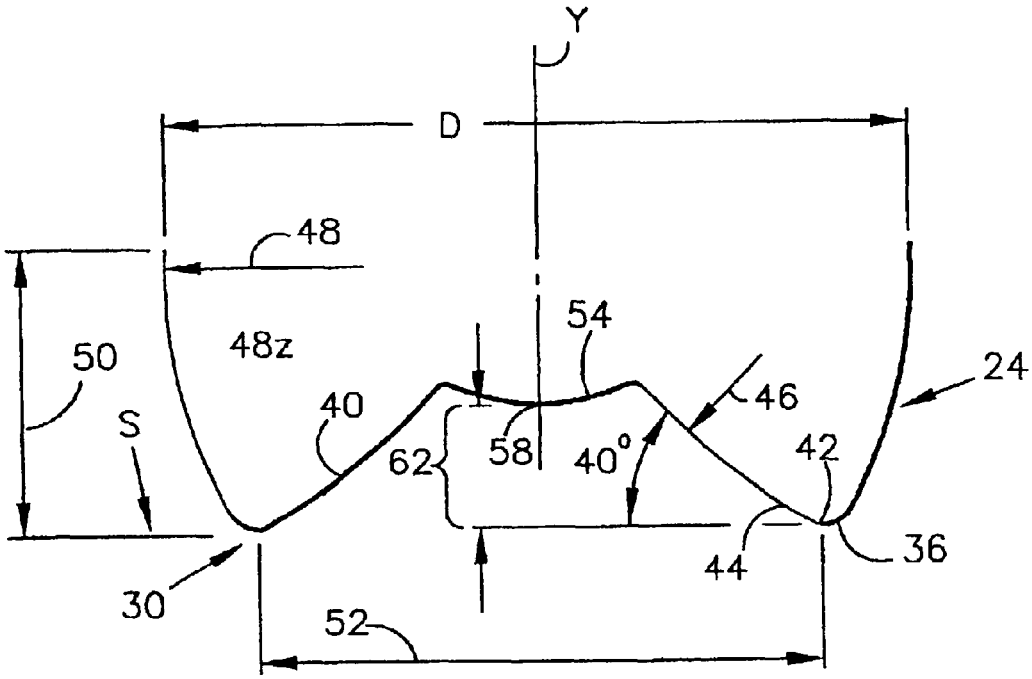
FIG. 5 is a diagrammatic sectional view of a fourth preferred embodiment for a base suitable for use in the bottle of FIG. 1 in which the first surface of the central concavity is slightly convex.

FIG. 5 shows a fourth preferred embodiment for a base 24 suitable for use in the bottle of FIG. 1 in which the first surface 40 of the central concavity is slightly convex as a result of the center of curvature of the vertical radius 46 being located above the surface 40. In this embodiment, the surface 40 is formed by rotation of a curve having a radius of about 0.82 D, or about 5.1 cm., about the longitudinal axis Y so that the surface 40 is inclined at an angle of about 40° above the surface S. This slightly convex curvature to surface 40 reduces, but does not eliminate the abrupt edge 42 at the junction of the inner portion 44 and the outer portion 36 of the standing ring 30. In the embodiment shown in FIG. 5, the lowermost point 58 of the second surface 54 is situated at about the same height as the embodiments shown in FIGS. 2 and 3, and the radius of curvature of the second surface 54 is also the same. Despite the difference in the curvature of surface 40, the performance of bottles having this base are nearly the same as the first embodiment shown in FIG. 2.

Figure 6:
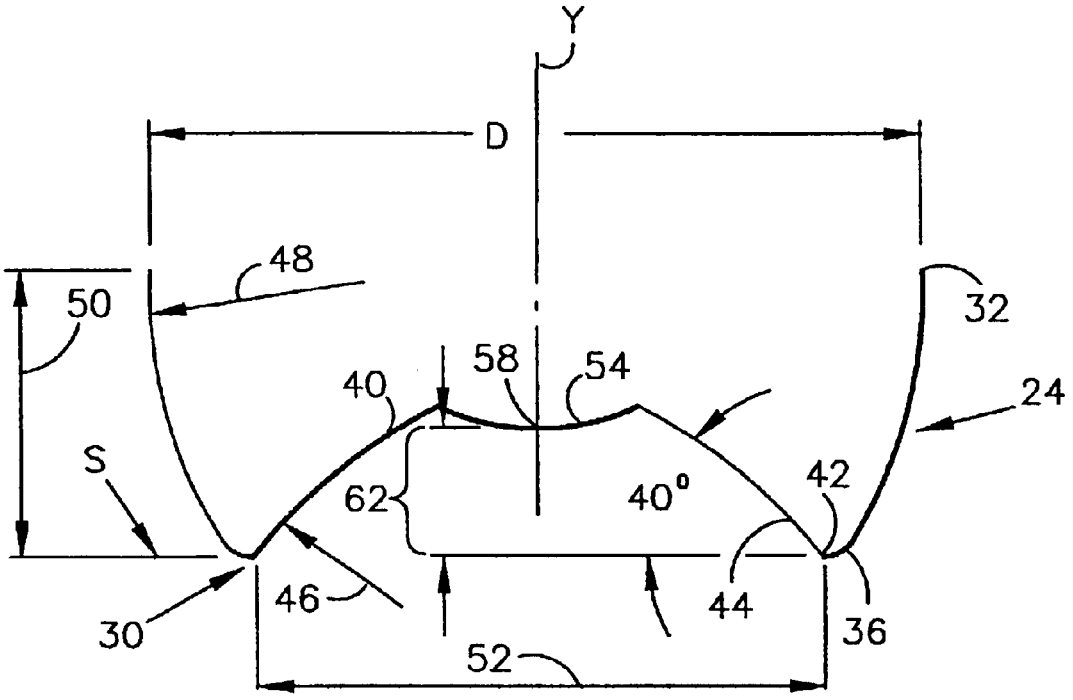
FIG. 6 is a diagrammatic sectional view of a fifth preferred embodiment for a base suitable for use in the bottle of FIG. 1 in which the first surface of the central concavity is concave.

FIG. 6 shows a fifth preferred embodiment for a base 24 suitable for use in the bottle 10 of FIG. 1 in which the first surface 40 of the central concavity 28 is slightly concave as a result of the center of curvature of the vertical radius 46 being located below the surface 40. In this embodiment, the surface 40 is formed by rotation of a curve having a radius length identical to that of the fourth preferred embodiment about the longitudinal axis Y so that the surface 40 is again inclined at an angle of about 40° above the surface S. This slightly concave curvature to surface 40 enhances the abrupt edge 42 at the junction of the inner portion 44 and the outer portion 36 of the standing ring 30. There is a small enhancement in resistance to roll-out that is achieved by this change in location of the center of curvature as compared to the embodiment shown in FIG. 5. Again, the lowermost point 58 of the second surface 54 is situated at about the same height as the embodiments shown in FIGS. 2 and 3, and the radius of curvature of the second surface 54 is also the same. Despite the difference in the curvature of surface 40, the performance of bottles having this base are nearly the same as the first embodiment shown in FIG. 2.

Figure 7:
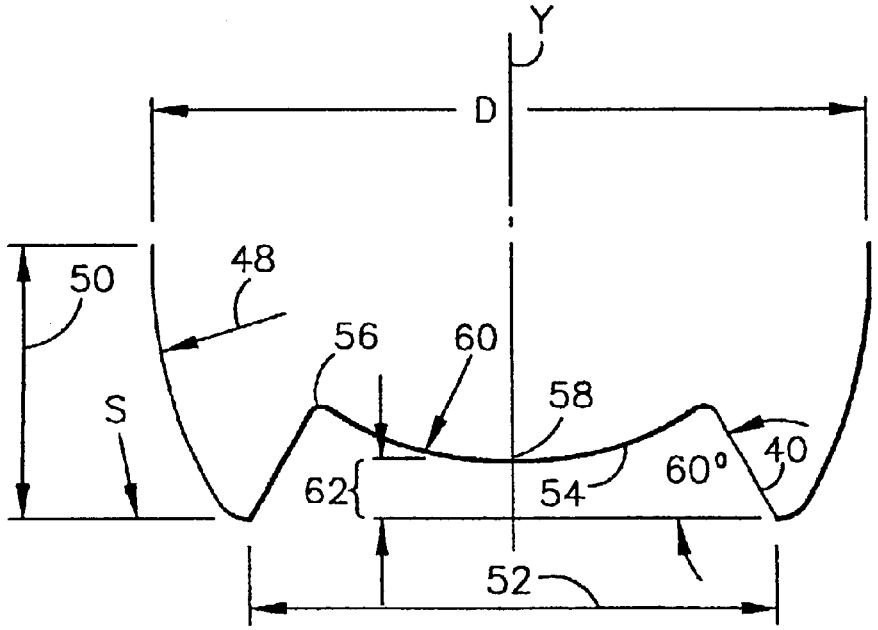
FIG. 7 is a diagrammatic sectional view of a sixth preferred embodiment for a base suitable for use in the bottle of FIG. 1 in which the second surface has a larger radius and extends over a larger area than in the previous figures.

FIG. 7 shows a sixth preferred embodiment for a base 24 suitable for use in We bottle 10 of FIG. 1 in which the second surface 54 has a larger radius of curvature 60 than in the prior embodiments. The radius of curvature 60 is about 0.5 D or about 3.1 cm and extends over a larger area than in the previous figures. The outer margin 56 of the second surface 54 is located at about 0.3 D from the longitudinal axis Y while the lowermost point 58 is situated at a height 62 of only about 0.08 D or about 5.1 mm above the surface S. The first surface 40 is again a conical surface inclined at an angle of 60° above the plane S which is believed to be near the limit of inclination that can be employed for surface 40. Any further increase has a tendency to prevent complete filling of the standing ring 30 by the polymer forming the bottle 10. Additionally, the sixth embodiment may represent another limit for the curvature of the surface 54 when extended laterally over such a large area. In general larger curvatures are to be preferred.

Figure 8:
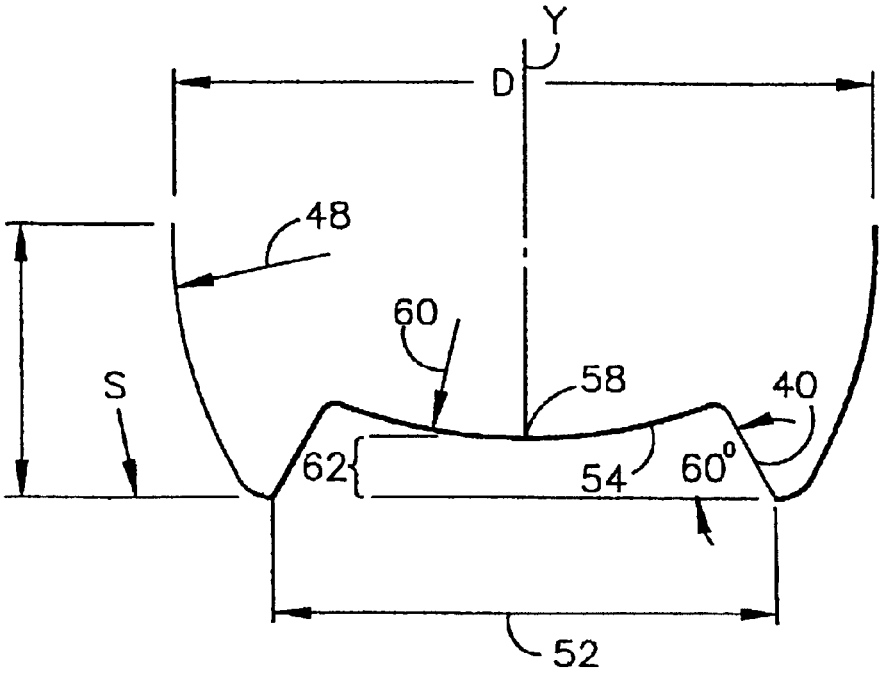
FIG. 8 is a diagrammatic sectional view of a seventh preferred embodiment for a base suitable for use in the bottle of FIG. 1 in which the second surface has a larger radius than in FIG. 7.
Figure 9:
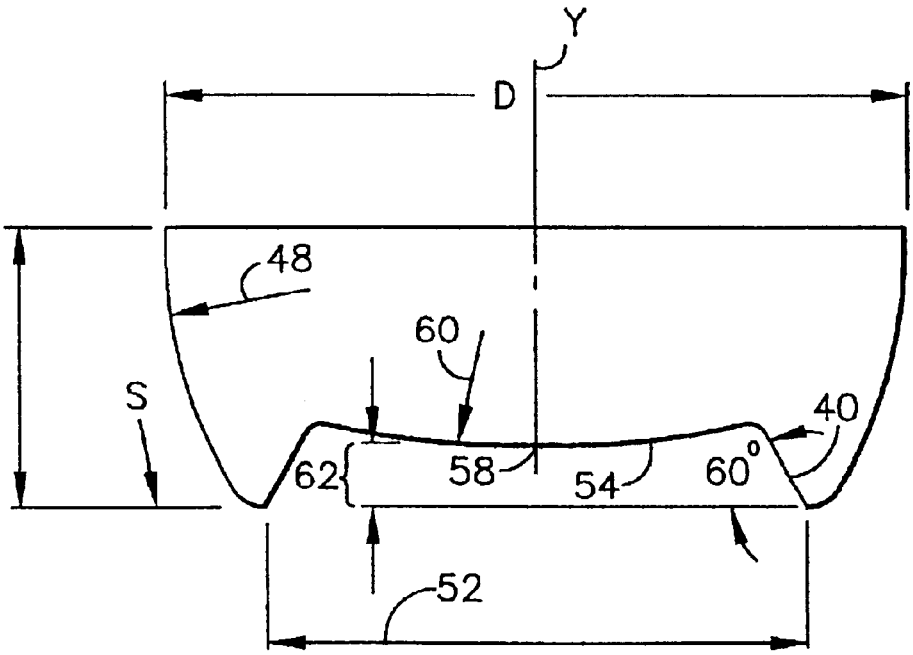
FIG. 9 is a diagrammatic sectional view of an eighth preferred embodiment for a base suitable for use in the bottle of FIG. 1 in which the second surface has a larger radius than in either FIG. 7 or 8.

FIGS. 8 and 9 show a seventh and an eighth preferred embodiment for a base 24 suitable for use in the bottle 10 of FIG. 1. In both embodiments, the second surface 54 has a larger radius of curvature 60 than in the sixth embodiment shown in FIG. 7. In the seventh embodiment, the radius of curvature 60 is about 0.82 D or about 6.1 cm while in the eighth embodiment the radius of curvature 60 is about 1.2 D, or about 7.6 cm. The first surface 40 is situated the same in all three embodiments shown in FIGS. 7 through 9 as is the lowermost point 58 of the second surface 54 in relation to the surface S. All of the last three embodiments perform satisfactorily, however the embodiments shown in FIGS. 2 and 6 perform at least as well when filled with beer at the usual levels of carbonation.

Although several embodiments of this invention have been specifically illustrated and described herein, it is to be understood that variations may be made in the bottle 10 and in the base 24 consistent with the teachings of this disclosure without departing from the scope of the invention as defined by the appended claims.

What is claimed is:

1. A molded plastic bottle having a sidewall and a bottom structure closing the container at a lower end portion of the sidewall, the bottom structure having an outside surface rotationally symmetric about a longitudinal axis of the bottle, the outside surface comprising:

a convex heel having an upper margin of diameter D integrally formed with the lower end portion of the sidewall and a lower margin defining an outer portion of a standing ring for supporting the bottle on any underlying surface, the standing ring outer portion having a vertical inside radius of curvature of at least about 0.04 D, and a central concavity including a first surface having a lower most portion defining an inner portion of the standing ring, the first surface having a vertical curvature radius of at least about 0.8 of D, the standing ring inner portion and outer portion intersecting in an abrupt edge defining a circle lying in a plane normal to said axis, the inner portion of the standing ring being inclined with respect to the plane at an angle of between about 30° and 50°.

2. A molded plastic bottle having a sidewall and a bottom structure closing the container at a lower end portion of the sidewall, the bottom structure having an outside surface rotationally symmetric about a longitudinal axis of the bottle, the outside surface comprising:

a convex heel having an upper margin of diameter D integrally formed with the lower end portion of the sidewall and a lower margin defining an outer portion of a standing ring for supporting the bottle on any underlying surface, wherein the upper margin of the convex heel has a vertical inside radius of curvature of between about 0.7 and 0.8 D, the standing ring outer portion having a vertical inside radius of curvature of at least about 0.04 D, and a central concavity including a first surface having a lower most portion defining an inner portion of the standing ring, the first surface having a vertical curvature radius of at least about 0.8 of D, the standing ring inner portion and outer portion intersecting in an abrupt edge defining a circle lying in a plane normal to said axis, the inner portion of the standing ring being inclined with respect to the plane at an angle of between 20° and 60°.

3. A molded plastic bottle having a sidewall and a bottom structure closing the container at a lower end portion of the sidewall, the bottom structure having an outside surface rotationally symmetric about a longitudinal axis of the bottle, the outside surface comprising:

a convex heel having an upper margin of diameter D integrally formed with the lower end portion of the sidewall and a lower margin defining an outer portion of a standing ring for supporting the bottle on any underlying surface, wherein the upper margin of the convex heel is located at between about 0.35 D and 0.40 D, above said plane containing the standing ring, the standing ring outer portion having a vertical inside radius of curvature of at least about 0.04 D, and a central concavity including a first surface having a lower most portion defining an inner portion of the standing ring, the first surface having a vertical curvature radius of at least about 0.8 of D, the standing ring inner portion and outer portion intersecting in an abrupt edge defining a circle lying in a plane normal to said axis, the inner portion of the standing ring being inclined with respect to the plane at an angle of between 20° and 60°.

4. A molded plastic bottle having a sidewall and a bottom structure closing the container at a lower end portion of the sidewall, the bottom structure having an outside surface rotationally symmetric about a longitudinal axis of the bottle, the outside surface comprising:

a convex heel having an upper margin of diameter D integrally formed with the lower end portion of the sidewall and a lower margin defining an outer portion of a standing ring for supporting the bottle on any underlying surface, the standing ring outer portion having a vertical inside radius of curvature of between about 0.045 D and 0.095 D, and a central concavity including a first surface having a lower most portion defining an inner portion of the standing ring, the first surface having a vertical curvature radius of at least about 0.8 of D, the standing ring inner portion and outer portion intersecting in an abrupt edge defining a circle lying in a plane normal to said axis, the inner portion of the standing ring being inclined with respect to the plane at an angle of between 20° and 60°.

5. A molded plastic bottle according to any of claim 1, 2, 3 or 4 wherein the central concavity further comprises a second surface having an outer margin spaced uniformly inward from the standing ring and integrally formed with the first surface.

6. A molded plastic bottle according to claim 5 wherein the second surface is downwardly convex and including a lowermost point coincident with the longitudinal axis and spaced from said plane.

7. A molded plastic bottle according to claim 6 wherein the space between the lowermost point and the plane is between about 0.05 D and 0.3 D.

8. A molded plastic bottle according to claim 6 wherein the second surface has a radius of curvature of between about 0.25 D and 0.85 D.

9. A molded plastic bottle according to claim 5 wherein the outer margin of the second surface is positioned between about 0.1 D and 0.3 D from the longitudinal axis of the bottle.

10. A molded plastic bottle according to any of claim 2, 3, or 4 wherein the inner portion of the standing ring is inclined with respect to the plane at an angle of between about 30° and 50°.

11. A molded plastic bottle according to claim 10 wherein the inner portion of the standing ring is inclined with respect to the plane at an angle of about 40°.

12. A molded plastic bottle according to any of claim 1, 2, 3, or 4 wherein the standing ring circle has a diameter of between about 0.7 D and 0.8 D.

13. A molded plastic bottle according to any of claim 1, 2, 3, or 4 wherein the first surface has a vertical curvature radius that is infinite so that the first surface is a conical portion.

14. A molded elastic bottle according to any of claim 1, 3 or 4 wherein the upper margin of the convex heel has a vertical inside radius of curvature of between about 0.7 and 0.8 D.

15. A molded plastic bottle according to any of claim 1, 2 or 4 wherein the upper margin of the convex heel is located at between about 0.35 D and 0.40 D, above said plane containing the standing ring.

16. A molded plastic bottle according to any of claim 1, 2 or 3 wherein the standing ring outer portion vertical inside radius of curvature is between about 0.45 D and 0.095 D.

17. A molded plastic bottle having a sidewall and a bottom structure closing the container at a lower end portion of the sidewall, the bottom structure having an outside surface rotationally symmetric about a longitudinal axis of the bottle, the outside surface comprising:

a convex heel having an upper margin of diameter D integrally formed with the lower end portion of the sidewall and a lower margin defining an outer portion of a standing ring for supporting the bottle on any underlying surface, the standing ring outer portion having a vertical inside radius of curvature of between about 0.045 D and 0.095 D, and a central concavity including a first surface having a lower most portion defining an inner portion of the standing ring and a second surface having an outer margin spaced uniformly inward from the standing ring and integrally formed with the first surface, the second surface being downwardly convex and including a lowermost point coincident with the longitudinal axis and spaced from any underlying supporting surface, the first surface having a vertical curvature radius of at least about 0.8 of D, the standing ring inner portion and outer portion intersecting in an abrupt edge defining a circle lying in a plane normal to said axis, the inner portion of the standing ring being inclined with respect to the plane at an angle of between about 30° and 50°.

18. A molded plastic bottle according to claim 17 wherein the upper margin of the convex heel is located at between about 0.35 D and 0.40 D, above said plane containing the standing ring, and has a vertical inside radius of curvature of between about 0.7 and 0.8 D.

19. A molded plastic bottle according to claim 17 wherein the second surface has a radius of curvature of between about 0.25 D and 0.85 D, and the space between the lowermost point of the second surface and the plane containing the standing ring is between about 0.05 D and 0.3 D.

* * * * *